United States Patent [19]

Weyde et al.

[11] 4,450,225

[45] May 22, 1984

[54] SILVER HALIDE EMULSION PREPARED BY CONVERTING SILVER PHOSPHATE

[75] Inventors: Edith Weyde, Kuerten; Harald von Rintelen, Leverkusen; Wilhelm Saleck, Bergisch Gladbach; Heinz-Horst Teitscheid, Leverkusen, all of Fed. Rep. of Germany

[73] Assignee: Agfa-Gevaert Aktiengesellschaft, Leverkusen-Bayerwerk, Fed. Rep. of Germany

[21] Appl. No.: 499,421

[22] Filed: Jun. 2, 1982

Related U.S. Application Data

[63] Continuation of Ser. No. 305,949, Sep. 28, 1981, abandoned.

[30] Foreign Application Priority Data

Oct. 3, 1980 [DE] Fed. Rep. of Germany ..... 3037385

[51] Int. Cl.[3] ..... G03C 1/02

[52] U.S. Cl. ..... 430/567; 430/568; 430/569; 430/943

[58] Field of Search ..... 430/567, 569, 568, 617, 430/619, 943

[56] References Cited

U.S. PATENT DOCUMENTS

| | | | |
|---|---|---|---|
| 962,788 | 6/1910 | Schwartz | 430/617 |
| 3,622,318 | 11/1971 | Evans | 430/552 |
| 4,173,482 | 11/1979 | Akashi et al. | 430/567 |
| 4,260,674 | 4/1981 | Weyde et al. | 430/567 |

OTHER PUBLICATIONS

Maskasky, "Silver Iodide Phosphate Photographic Emulsion", *Research Disclosure,* No. 18153, 5/1979, p. 235.

*Primary Examiner*—Richard L. Schilling
*Attorney, Agent, or Firm*—Connolly and Hutz

[57] ABSTRACT

New silver halide emulsions are prepared at least partly by converting a silver phosphate with a water soluble halide.

11 Claims, No Drawings

SILVER HALIDE EMULSION PREPARED BY CONVERTING SILVER PHOSPHATE

CROSS REFERENCE TO RELATED APPLICATION

This application is a continuation of copending application Ser. No. 305,949, filed Sept. 28, 1981 by the same inventors, now abandoned.

This invention relates to a silver halide emulsion and to a photographic material for a process for producing photographic images by the imagewise exposure of a layer containing a photosensitive silver salt and the decomposition of peroxide compounds over the exposed areas, the image being made visible either physically by development of the gas vesicles formed during decomposition or chemically by utilising the oxygen formed during decomposition for a dye-producing oxidation reaction. The invention also relates to a process for producing photographic images.

The production of photographic images by the imagewise formation of compounds forming gas vesicles particularly hydrogen peroxide, is known per se. U.S. Pat. No. 3,615,491 describes a process fo the production of photographic images consisting of a silver image and a vesicular image superimposed thereon.

In this process, a silver image is first conventionally produced in a hydrophilic layer, although it does show considerably less coverage than the conventional black-and-white images normally produced. The layer is then brought into contact with hydrogen peroxide, the hydrogen peroxide being decomposed to form small oxygen gas vesicles over those areas where the silver is present imagewise in finely divided form. When the exposed material is subsequently heated, the gas released expands and a vesicular image is formed. Since the bubbles obtained scatter the light imagewise, these areas appear dark in transmitted light, but light against a dark background when viewed in reflected light.

Most of the incident light is allowed through in the unexposed parts of the layer. In this way, the silver image is intensified to a very considerable extent, deep black images characterised by a high contrast in transmitted light being obtained, even where layers of very low silver content are used. The quality of the photographic images obtained by this process is excellent.

It is also known that the oxygen formed during the imagewise decomposition of hydrogen peroxide can be made visible chemically by using it for a dye-producing oxidation reaction rather than physically by bubble formation as described above. In this process, a photosensitive layer is exposed with imagewise formation of nuclei of noble metals of sub-Groups I and VIII of the Periodic System, after which this layer is treated with peroxy compounds which decompose catalytically on the nuclei formed imagewise in the presence of reaction components for a dye-producing oxidation reaction.

German Offenlegungsschrift No. 2,418,997, British Pat. No. 1,510,470 and U.S. Pat. Nos. 4,065,312 and 4,260,674 describe a photographic material for the dry production of photographic images by the imagewise exposure of a self-supporting or supported photosensitive layer containing dispersed photosensitive silver salts which on exposure form catalysts for the decomposition of peroxide compounds, and subsequent treatment of the exposed layer with a peroxide compound to form a visible image, the photosensitive layer containing the silver salt in quantities of from 1 to 500 mg/m$^2$, the silver salt dispersion having a $p_{Ag}$-value below the equivalence point before casting, the grain size of the silver salt grains being smaller than 0.3 μm and the transparency of the photographic material amounting to at least 80%. In this material, decomposition of the peroxide compounds is catalysed by much finer silver.

The last of the above-described processes gives very sharp images with minimal graininess. However, the photosensitivity of this material is poor because it is not possible to use relatively coarse-grained silver halide emulsions for increasing sensitivity as is normally the case, because the $H_2O_2$ would no longer be decomposed in the required manner.

An object of the present invention is to provide more sensitive silver halide emulsions. In particular, an object of the present invention is to provide more sensitive silver halide emulsions which are suitable for a material in which an image is produced by the decomposition of peroxide compounds.

Accordingly, the present invention provides:

1. A photosensitive silver halide emulsion which has been produced at least partly by converting a silver phosphate with a water-soluble halide.

2. A photographic material for a process for producing photographic images by the imagewise exposure of a self-supporting or supported photosensitive layer containing photosensitive silver salts which are capable after exposure of forming catalysts for the decomposition of peroxide compounds, and subsequent treatment of the exposed layer with a peroxide compound to form a visible image. According to the invention, the photographic material contains a photosensitive silver halide emulsion which has been obtained at least partly by converting a silver phosphate with a water-soluble halide into a silver halide. Further layers may be present.

3. A process for the production of photographic images by the imagewise exposure of the material described in 2, followed by treatment with a peroxide, optionally with the assistance of at least one heat treatment and/or development with a photographic developer.

Suitable photosensitive silver halides are silver chloride, silver bromide or mixtures thereof, optionally with a molar silver iodide content of preferably up to 10%.

The silver halide grains have an average grain size of in general less than 0.6 μm, particularly less than 0.3 μm and preferably less than 0.1 μm. In one preferred embodiment, the average grain size is from 0.05 to 0.6 μm and, more particularly, from 0.1 to 0.4 μm. At least 50% of the grains are preferably at most 0.3 μm large.

The silver phosphate to be converted preferably has a very fine grain, preferably with an average grain size of from 0.05 to 0.3 μm. Silver phosphate as fine as this may be obtained for example as follows:

(a) initially introducing silver nitrate into the gelatin solution in the precipitation vessel and briefly adding $Na_2HPO_4$, (b) precipitating very fine-grained $MgHPO_4$ which is converted with silver nitrate into silver phosphate, (c) initially introducing a gelatin-containing phosphoric acid solution, adding silver nitrate and precipitating the silver phosphate by rapidly increasing the pH-value, (d) adjusting the gelatin solution in the precipitation vessel to pH 2 and adding $Na_2HPO_4$ together with silver nitrate, fine-grained silver phosphate being precipitated by subsequently increasing the pH-value, or (e) in two stages in accordance with German Pat. No. 1,472,745 and U.S. Pat. No. 3,790,386.

In the context of the invention, "silver phosphates" are understood to be salts of silver with one of the acids of phosphorus in which the phosphorus atom is pentavalent. Silver phosphates of this type are known and are described, for example, in Frieser, Haase, Klein: "Die Grundlagen der fotografischen Prozesse mit Silberhalogeniden", Akademische Verlagsanstalt, Frankfurt-/Main, 1968, Vol. 1, pages 473 to 474. One particularly preferred silver phosphate is $Ag_3PO_4$.

The silver salts are preferably prepared in the presence of a suitable peptising agent. Suitable peptising agents are, for example, gelatin, particularly photographically inert gelatin, cellulose derivatives such as cellulose esters or ethers, for example cellulose sulphate, carboxy methyl cellulose or cellulose acetates, particularly cellulose acetates having a degree of acetylation of up to 2, and synthetic polymers, such as polyvinyl alcohols, partially hydrolysed polyvinyl esters, for example, partially hydrolysed polyvinyl acetate, or polyvinyl pyrrolidone.

In one preferred embodiment, the silver salts are prepared in the presence of a colloidal silica sol. The usual silica sols may be used for this purpose irrespective of whether the silica has been produced by a wet fusion process or by a pyrogenic process. The size of the colloidal silica particles in the sol should be relatively small and should not exceed 100 nm. Particle sizes of from 7 to 100 nm have proved to be advantageous.

Mixed oxides of silicon dioxide and aluminium oxide, in which the aluminium oxide content may amount to 20% by weight of the solids content, are also suitable.

The concentration of the silica in the silica sol may vary within wide limits. The type and concentration of silica sol suitable for the particular silver halide emulsion may be determined without difficulty by a few simple small-scale tests.

Particularly suitable peptising agents are copolymers containing recurring 8-oxyquinoline units, the proportion of 8-oxyquinoline in the copolymer being from 0.1 to 20% by weight and preferably from 0.1 to 10% by weight. Suitable comonomers are above all water-soluble comonomers. In some cases, it can also be of advantage to incorporate other polymerisable monomers less readily soluble in water.

Copolymers obtained by polymerising 8-oxy-quinoline-containing acrylic acid derivatives with acrylamide, acrylic acid and/or N-vinyl pyrrolidone have proved to be particularly suitable. Suitable copolymers are described, for example, in German Offenlegungsschrift No. 2,407,307.

Production of the silver phosphate and silver halide is preferably carried out in an excess of anions.

It was completely surprising to find that such a high degree of sensitivity is obtained by converting fine-grained silver phosphate which has virtually no photosensitivity.

The $p_{Ag}$-range which has to be maintained during precipitation of the silver salt, particularly a silver halide is not critical, although it is preferably from 6 to 10. The pH-range in the precipitation medium may be in particular from 3 to 7. Particularly good results are obtained at pH values in the range of from 3 to 5.

The silver salt emulsion obtained may be washed after precipitation although this step is unnecessary on account of the thin covering of silver in the materials according to the invention. In the materials according to the invention, these halide-containing photosensitive layers have a very low silver content (expressed as silver nitrate) which generally amounts to between 1 and 500 mg and preferably to between 200 and 400 mg per square meter. The photosensitive layer has a layer thickness of preferably from 0.5 to 15 μm and more particularly from 2 to 10 μm.

The silver halide dispersion may also be chemically sensitised, for example, with reducing agents, such as tin(II) salts, polyamines such as diethylene triamine, sulphur compounds, as described in U.S. Pat. No. 1,574,944 or in MEES' book entitled "Theory of the Photographic Process" (1954), pages 149 to 161. The described emulsions may also be chemically sensitised with salts of noble metals, such as ruthenium, rhodium, palladium, iridium, platinum or gold, as described in the Article by R. Koslowsky in Z. Wiss. Phot. 46 (1951), pages 65 to 72. Other suitable chemical sensitisers are compounds from the thiomorpholine series, for example, those described in French Pat. No. 1,506,230, or even polyalkylene oxides, particularly polyethylene oxide and derivatives thereof.

The silver halide dispersions may also be optically sensitised, for example with the usual polymethine dyes, such as neutrocyanines, basic or acid carbocyanines, merocyanines or rhodacyanines, hemicyanines, styryl dyes, oxanols and the like. Sensitisers of this type are described in F. M. Hamer's book entitled "The Cyanine Dyes and Related Compounds" (1964).

Where hardenable binders are used for dispersing the silver salts, they may be hardened in the usual way, for example, with formaldehyde or with halogen-substituted aldehydes containing a carboxyl group, such as mucobromic acid, diketones, methane sulphonic acid esters, dialdehydes and the like. Instant hardening agents are particularly suitable.

To improve their stability in storage, the emulsions according to the invention may contain oxidation inhibitors known per se, such as alkali metal sulphite, bisulphite addition products of aldehydes and ketones, preferably cycloalkyl ketones, particularly cyclohexanone bisulphite.

To improve the stability of the image nuclei and photosensitivity, the materials according to the invention may contain compounds known per se which are capable of acting as halogen acceptors, such as for example silver salts, reducing agents and developer substances. The latter also act as developer substances in the heat treatment of the exposed material and may be present in a photosensitive or non-photosensitive layer.

The positive effect of compounds of the type in question may be attributable to the fact that the halogen formed in the primary reaction during exposure is intercepted. The destruction of the latent silver image nuclei by this halogen is thus prevented.

Suitable compounds are, for example, silver salts of the type described in German Offenlegungsschrift No. 2,418,997, pages 8 to 9.

A stabilising and hence photosensitivity-improving effect is shown by reducing agents, such as hydrazines and their derivatives, substituted hydrazines, acylated hydrazines, particularly hydrazides, also amino phenols, amino-substituted benzene compounds, particularly phenylene diamine, and substitution products thereof, for example, the following:

Hydrazides tartaric acid dihydrazide, malonic acid dihydrazide, malic acid dihydrazide, mucic acid dihydrazide and citric acid trihydrazide.

Polyamines diethylene triamine

Hydroxylamine derivatives

N-ethyl-N'-hydroxy urea, N-phenyl-N'-hydroxy urea, N-hydroxy urea, N-hydroxy benzamide, N-hydroxy carbamic acid ethyl ester Phenols pyrocatechol, hydroquinone, 1,4-dihydroxy phthalimide, DL-d-methyl-β-(3,4-dihydroxyphenyl alanine), homogentisic acid, homogentisic acid amide and 2,5-dihydroxyphenyl-5-(1-phenyl tetrazolyl)-sulphide Phenylene diamines N,N-diethyl-N'-sulphomethyl-p-phenylene diamine, N,N-dimethyl-N'-sulphomethyl-p-phenylene diamine and 3-methyl-4-sulphomethylamino-N,N-diethylene aniline 3-pyrazolidones 1-phenyl-3-pyrazolidone, 1-m-toluene-3-pyrazolidone, 1-p-toluyl-3-pyrazolidone, 1-phenyl-4-methyl-3-pyrazolidone, 1-phenyl-5-methyl-3-pyrazolidone, 1,4-dimethyl-3-pyrazolidone, 4-methyl-3-pyrazolidone, 4,4-dimethyl-3-pyrazolidone, 1-phenyl-2-acetyl-3-pyrazolidone, 1-phenyl-4,4-dimethyl-3-pyrazolidone, 1-(4-bromophenyl)-3-pyrazolidone, 1-p-toluyl-4-hydroxy methyl-4-methyl-3-pyrazolidone and 1-phenyl-4-hydroxymethyl-4-methyl-3-pyrazolidone.

The above compounds are added to the photographic layer before casting. Their concentration may vary within wide limits and depends upon the effectiveness of the compound and the purpose for which it is intended. In general, concentrations of from 10 to 500 mg per square meter of material have proved to be of advantage. Hydrazines and Hydrazides are particularly used in concentrations of 10 to 200 mg/m$^2$.

The above compounds by which stability and photosensitivity are improved may also be used in admixture with one another. Optimal combinations may be determined without difficulty by a few laboratory tests.

The photographic material may contain dye-producing compounds, for example, the usual colour couplers, which may be incorporated in the silver halide layers themselves. For examples of suitable colour couplers, see the Article entitled "Farbkuppler (Colour Couplers)" by W. PELZ in "Mitteilungen aus den Forschungslaboratorien der Agfa, Leverkusen/Munchen", Vol. III (1961) and K. VENKATARAMAN in "The Chemistry of Synthetic Dyes", Vol. 4, 341 to 387, Academic Press, 1971.

Other suitable couplers are 2-equivalent couplers, for example, the known DIR couplers. The colour couplers may be added to the photosensitive silver halide emulsions or to other casting solutions by standard known methods.

Where the couplers are water-insoluble or alkali-insoluble compounds, they may be emulsified in known manner. So-called coupler solvents or oil formers may have to be additionally used for incorporating hydrophobic compounds of the type in question by emulsification; cf. for example, U.S. Pat. Nos. 2,322,027; 2,533,514; 3,689,271; 3,764,336 and 3,765,897.

The photographic materials may contain the usual stabilisers such as, for example, tri or tetra-azaindolizines, particularly those substituted by at least one hydroxyl and/or amino group. Indolizines of this type are described, for example, in the article by BIRR in Z. Wiss. Phot. 47 (1952), pages 2 to 58 and in U.S. Pat. No. 2,944,901. In addition, benzotriazoles or heterocyclic mercapto compounds, for example, 3-mercapto-4-amino-1,2,4-triazole, 3-mercapto-4-(p-sulphonic acid phenylamino)-5-methyl-1,2,4-triazole may be used.

The photographic materials may contain the substances which are normally used for improving the evolution of heat in thermal development processes and which give off water under heat, or hydrophilic compounds which increase the residual moisture of the layer. Compounds of the first type are, for example, ureas, caprolactams, β-nitroethanols or β-cyanoethanols and salts which form defined hydrates, such as sodium acetate, sodium citrate or sodium sulphate.

Polyalcohols and mono- and oligo-saccharides are substances of the second type. The advantage of the latter substances is that, in addition to the effect thereof in heat development described in German Pat. No. 1,174,157, they are oxidized to acids by hydrogen peroxide, thereby lowering the pH of the processed layers. The frequently observed discolouration of images by light is prevented by this lowering of the pH by the acids formed, e.g. saccharic acids.

The transparency of the materials according to the invention should preferably amount to at least 80%. This means that the material according to the invention should absorb no more than 20% of visible light, the reference value being the transparency of a sheet-form material of the same structure and composition, but without any silver salts or other additions.

The transparent layer supports known for photographic materials are suitable for the material according to the invention. Layer supports such as these include, for example, films of cellulose esters, polyesters based on polyethylene terephthalic acid ester or polycarbonates, particularly polycarbonates based on bisphenol A. In selecting suitable layer supports, it is of course important to ensure that they are stable at the processing temperature.

Basically, the material according to the invention may be used in any known processes for the production of photographic images by the imagewise decomposition of peroxide compounds. Processes such as these include processes in which the decomposition of a peroxide compound takes place on relatively coarse nuclei of metallic silver which are formed after exposure and photographic development. However, the material according to the invention is particularly suitable for a process in which, following imagewise exposure, a first heat treatment is carried out, preferably in the presence of a reducing agent, before the treatment with a peroxide to be decomposed. This is done by straight forward heating to temperatures preferably in the range of from 80° to 130° C. The heating time may vary within wide limits and is generally between 2 and 30 seconds.

The material according to the invention is then treated with a peroxide compound in known manner. The simplest way of doing this is to bring the exposed layer into contact with vapours of a peroxide compound in the presence of heat. The most suitable peroxide compounds for this purpose are hydrogen peroxide or compounds which give off hydrogen peroxide under heat, for example, percarbamide and the materials described in German Offenlegungsschrift No. 2,420,521. One such process is known from German Offenlegungsschrift No. 2,418,997.

In one preferred embodiment, the exposed layer is brought into contact with a sheet-form material containing hydrogen peroxide or addition products thereof. The layer and the material are then heated in contact, hydrogen peroxide being transferred from the support layer to the exposed silver salt dispersion layer. A vesicular image or, if the silver salt dispersion layer contains reaction components for a dye-producing oxidation reaction, a visible dye image is formed in the silver salt dispersion layer.

The two possibilities of producing visible images by the imagewise decomposition of peroxide compounds are described in U.S. Pat. Nos. 3,615,491 and 3,674,490.

Peroxide-containing layers of the type used in the preferred embodiment discussed above are described in U.S. Pat. No. 3,765,890.

The photographic materials according to the invention are distinguished by the fact that there are virtually no fogging problems. Whereas with conventional photographic materials and conventional processing by photographic development of the exposed material it is necessary largely to suppress the uniform, spontaneously developable fog in the unexposed material, a uniform fog of an intensity which in itself would be sufficient to rule out practical application in conventional photographic material does not occur in the material according to the invention as a result of processing.

Accordingly, the photographic material according to the invention is considerably easier and less expensive to produce. The materials according to the invention give photographic images of relatively steep gradation. Because of this, they are eminently suitable for use as copying films, particularly as microfilms, for archival purposes. Otherwise they may be used for a variety of different purposes. They are also particularly favourable for example for computer applications.

The following Examples illustrate the invention. Percentages are by weight unless otherwise indicated.

EXAMPLE 1

Comparison Material (Prior Art)

This material is known from U.S. Pat. No. 4,065,312.

A mixture of 250 ml of a 10% aqueous solution of inert gelatin and 50 ml of a 2% aqueous solution of silver nitrate are initially introduced and 10 ml of a 5% aqueous solution of potassium bromide are added thereto. The emulsion is solidified in the usual way. It has a $p_{Ag}$-value of 3.75. The silver bromide grains have an average grain diameter of 0.015 μm.

Before casting, 2.5 ml of a 30% aqueous saponin solution and 15 ml of a 10% aqueous solution of 1-phenyl-3-pyrazolidone are added, followed by adjustment with borax to a pH-value of from 5.7 to 5.8.

The emulsion is applied to a layer support of cellulose triacetate with a silver concentration (in the form of silver halide) of 0.3 g per square meter. After drying at 28° C., the photographic material has a transparency of 90%. It is exposed and then heated for about 5 seconds to 100° C. in a heating press. The film thus treated is then heated in close contact with an $H_2O_2$-containing film to a temperature of approximately 100° C., for example, by means of a heating press.

The film is obtained by coating a cellulose acetate film with a solution of polyvinyl alcohol or carboxymethyl cellulose containing added hydrogen peroxide. The film contains approximately 2 to 6 g of $H_2O_2$ per square meter. The sensitometric values obtained are shown in Table 1.

EXAMPLE 2 (Invention)

The following solutions are prepared:

| | |
|---|---|
| Solution 1: | |
| $H_2O$ | 500 ml |
| gelatin | 0.5 g |
| polymer 1 | 2.5 g |
| pH | 4.0 |
| Solution 2: | |
| $H_2O$ | 200 ml |
| $AgNO_3$ | 2.1 g |
| Solution 3: | |
| $H_2O$ | 200 ml |
| $Na_2HPO_4$ | 0.75 g |
| Solution 4: | |
| $H_2O$ | 200 ml |
| KBr | 1.5 g |
| KI | 0.001 g |
| Solution 5: (allow to swell) | |
| $H_2O$ | 100 ml |
| gelatin | 100 g |

"Polymer 1" is polymer No. 4 described on page 8 of German Offenlegungsschrift No. 2,508,279. The same polymer is referred to as "polymer 4" in U.S. Pat. No. 4,152,161, columns 4–5.

Solutions 2 to 4 are rapidly tipped in that order into solution 1 with vigorous stirring. After digestion for 30 minutes at 40° C., solution 5 is slowly added and the emulsion is solidified. A pH-value of 6.3 and a potential $E_{Ag}$ of $+\beta$mV against calomel are measured.

The average grain diameter of the silver halide grains is 0.11 μm. The emulsion is cast onto a layer support in the same way as described in Example 1 and, after drying at 28° C., has a transparency of 88%. After exposure and further processing in the same way as in Example 1, the speed values quoted in Table 1 are obtained. A distinct increase in speed is obtained where the material according to the invention is used, the material according to the invention having been obtained by converting the silver phosphate formed on combination of solutions 2 and 3 by the halide contained in solution 4.

EXAMPLE 3 (Invention)

The procedure is the same as in Example 2, but with the following differences. 0.006 mg of $Na_2IrCl_6 \times 6\ H_2O$ is introduced into solution 1 two minutes before the beginning of precipitation. After precipitation, 4.4 mg of $KAuCl_4$ and 110 mg of $NH_4SCN$ are added, followed by digestion for 30 minutes. A pH-value of 6.3 and a potential of +70 mV are measured. The emulsion obtained is then further processed in the same way as in Example 1. The speed values quoted in Table 1 show that an additional increase in speed can be obtained in relation to Example 2.

EXAMPLE 4 (Invention)

The following solutions are prepared:

| | |
|---|---|
| Solution 1: | |
| $H_2O$ | 500 ml |
| gelatin | 0.5 g |
| polymer 1 | 2.5 g |
| pH | 4.0 |
| Solution 2: | |
| $H_2O$ | 200 ml |
| $AgN0_3$ | 2.1 g |
| Solution 3: | |
| $H_2O$ | 200 ml |
| $Na_2HPO_4$ | 0.75 g |
| Solution 4: | |
| $H_2O$ | 200 ml |
| KBr | 1.45 g |
| NaCl | 0.3 g |
| KI | 0.001 g |
| Solution 5: (allow to swell) | |
| $H_2O$ | 100 ml |
| gelatin | 100 g |

Solutions 2 to 4 are tipped into solution 1 in the same way as in Example 1. After digestion for 30 minutes at 40° C. with 4.4 mg of $HAuCl_4$ and 110 mg of $NH_4SCN$, solution 5 is added and the emulsion is solidified. The average grain diameter of the emulsion obtained amounts to 0.11 μm. The final pH value is 6.2 and the potential is 65 mV.

The emulsion is applied to a layer support, followed by further processing, in the same way as described in Example 1. The speed value quoted in Table 1 is obtained. A distinct increase in speed is again obtained in relation to the comparison sample.

EXAMPLE 5 (Invention)

The following solutions are prepared:

| | |
|---|---|
| Solution 1: | |
| $H_2O$ | 500 ml |
| gelatin | 0.5 g |
| polymer 1 | 2.5 g |
| pH | 4.0 |
| Solution 2: | |
| $H_2O$ | 100 ml |
| $Mg(NO_3)_2 \times 6\ H_2O$ | 0.7 g |
| Solution 3: | |
| $H_2O$ | 200 ml |
| $Na_2HPO_4$ | 0.75 g |
| Solution 4: | |
| $H_2O$ | 200 ml |
| $AgNO_3$ | 2.1 g |
| Solution 5: | |
| $H_2O$ | 200 ml |
| KBr | 1.5 g |
| KI | 0.001 g |
| Solution 6: (allow to swell) | |
| $H_2O$ | 100 ml |
| gelatin | 100 g |

Solutions 2 and 3 are tipped with vigorous stirring into solution 1 to form magnesium phosphate. Solution 4 is then added to form silver phosphate. Finally, solution 5 is added, converting the precipitated silver phosphate into silver halide. After digestion for 30 minutes at 40° C. with 4.4 mg of $HAuCl_4$ and 110 mg of $NH_4$ SCN, solution 6 is added and the emulsion is solidified. A final pH-value of 6.3 and a potential of 62 mV are measured. The emulsion obtained has an average grain diameter of 0.17 μm.

The emulsion is applied to a layer support in the same way as described in Example 1 and, after drying, has transparency of 90%. After processing in the same way as in Example I, the speed value quoted in Table 1 is obtained. It is apparent that a very distinct increase in speed can be obtained by the preliminary precipitation of magnesium phosphate.

EXAMPLE 6

The following solutions are prepared:

| | |
|---|---|
| Solution 1: | |
| $H_2O$ | 500 ml |
| gelatin | 0.5 g |
| polymer 1 | 2.5 g |
| pH | 2.0 |
| Solution 2: | |
| $H_2O$ | 200 ml |
| $AgNO_3$ | 2.1 g |
| Solution 3: | |
| $H_2O$ | 200 ml |
| $Na_2HPO_4$ | 0.70 g |
| Solution 4: | |
| $H_2O$ | 400 ml |
| NaOH | quantity sufficient to give a pH-value of 3.7 after precipitation |
| Solution 5: | |
| $H_2O$ | 200 ml |
| KBr | 1.5 g |
| KI | 0.001 g |
| Solution 6: (allow to swell) | |
| $H_2O$ | 100 ml |
| gelatin | 100 g |

Solutions 2 to 4 are rapidly tipped into solution 1 with vigorous stirring. Silver phosphate is formed. Silver halide is then formed by the addition of solution 5. After digestion for 30 minutes at 40° C. with 4.4 mg of $HAuCl_4$ and 110 mg of $NH_4SCN$, solution 6 is slowly added and the emulsion is solidified. A final pH-value of 6.3 and a potential of +62 mV are measured. The emulsion obtained has an extremely fine grain with an average grain size of 0.07 μm. The emulsion is applied to a layer support in the same way as in Example 1. The material obtained has a transparency of 88%. The material is exposed and further processed in the same way as in Example 1. As shown in Table 1, an extremely good increase in speed is obtained despite the particularly fine grain.

EXAMPLE 7

The following solutions are prepared:

| | |
|---|---|
| Solution 1: | |
| $H_2O$ | 500 ml |
| Silica sol | 20 ml |
| pH | 4 |
| phosphoric acid to adjust pH-value to | 4 |
| Solution 2: | |
| $H_2O$ | 200 ml |
| $AgNO_3$ | 2.1 g |
| Solution 3: | |
| $H_2O$ | 200 ml |
| KBr | 1.5 g |
| KI | 0.01 g |
| Solution 4: (allow to swell) | |
| $H_2O$ | 100 ml |
| gelatin | 100 g |

Solution 2 is tipped into solution 1 to form silver phosphate. Immediately afterwards solution 3 is added to form the silver halide. A pH-value of 4.2 is obtained.

After digestion for 30 minutes at 40° C. with 4.4 mg of $HAuCl_4$ and 110 mg of $NH_4SCN$, solution 4 is slowly added and the emulsion is solidified. A final pH-value of 5.7 and a final potential of +42 mV are measured. The emulsion has an average grain diameter of 0.19 μm. It is applied to a layer support in the same way as in Example 1, the material obtained having a transparency of 87%. This material is exposed and further processed in the same way as described in Example 1 and, as can be seen from Table 1, also shows extremely high speed

TABLE 1

| Example No. | Rel. speed* |
|---|---|
| 1 (Comparison) | 100 |
| 2 (Invention) | 500 |
| 3 (Invention) | 850 |
| 4 (Invention) | 750 |
| 5 (Invention) | 750 |
| 6 (Invention) | 800 |
| 7 (Invention) | 800 |

*a two-fold increase in the value quoted corresponds to a two-fold increase in speed.

We claim:

1. A light-sensitive photographic material of improved sensitivity for producing photographic images on imagewise exposure comprising at least one self-supporting or supported light-sensitive silver salt emulsion layer of improved sensitivity containing primarily silver halide wherein the silver halide contained in said silver salt emulsion is obtained by converting inorganic silver phosphate grains with a water-soluble halide.

2. The material as claimed in claim 1 wherein the silver halide grains of the emulsion have an average grain size of at most 0.6 μm.

3. The material as claimed in claim 1, wherein the average grain size of the silver phosphate grains to be converted is from 0.05 to 0.3μ.

4. The material as claimed in claim 1, wherein the silver phosphate to be converted corresponds to the formula $Ag_3PO_4$.

5. The material as claimed in claim 1, which is prepared in the presence of a polymer containing 8-oxyquinoline units.

6. The material as claimed in claim 1, wherein the transparency of the material amounts to at least 80%.

7. In a process for providing a silver halide emulsion of improved sensitivity for producing photographic images on imagewise exposure the improvement which comprises obtaining the silver halide emulsion by converting inorganic silver phosphate grains with a water-soluble halide to silver halide grains.

8. The process as claimed in claim 7, wherein the silver halide grains of the emulsion have an average grain size of at most 0.6 μm.

9. The process as claimed in claim 7, wherein the average grain size of the silver phosphate grains to be converted is from 0.05 to 0.3μ.

10. The process as claimed in claim 7, wherein the silver phosphate to be converted corresponds to the formula $Ag_3PO_4$.

11. The process as claimed in claim 7, wherein the silver halide is prepared in the presence of a polymer containing 8-oxyquinoline units.

* * * * *